United States Patent [19]

Moon

[11] 3,931,826

[45] Jan. 13, 1976

[54] BRUSH AND METHODS FOR MANUFACTURING SAME

[75] Inventor: Howard R. Moon, Fort Atkinson, Wis.

[73] Assignee: Wahl Clipper Corporation, Sterling, Ill.

[22] Filed: July 26, 1974

[21] Appl. No.: 492,234

[52] U.S. Cl. ..... 132/9; 132/85

[51] Int. Cl.[2] ..... A45D 1/00

[58] Field of Search ..... 132/9, 85, 11; 15/187

[56] References Cited

UNITED STATES PATENTS

| | | | |
|---|---|---|---|
| 1,375,681 | 4/1921 | Dennin | 132/85 |
| 2,741,786 | 4/1956 | Bressler | 132/85 |
| 3,651,532 | 3/1972 | Wettburg | 132/85 |
| 3,721,250 | 3/1973 | Walter | 132/11 |
| 3,739,419 | 6/1973 | Natman | 15/187 |

*Primary Examiner*—G. E. McNeill

*Attorney, Agent, or Firm*—Carl C. Batz

[57] ABSTRACT

A brush which has been molded in a substantially flat form but which is bent to form a roll with an arcuate cross section and with side flaps which are brought together and fastened to form a handle portion or which may be utilized to mount the brush in a styler/dryer device. Also methods by which such a brush are manufactured.

19 Claims, 9 Drawing Figures

Fig. 1
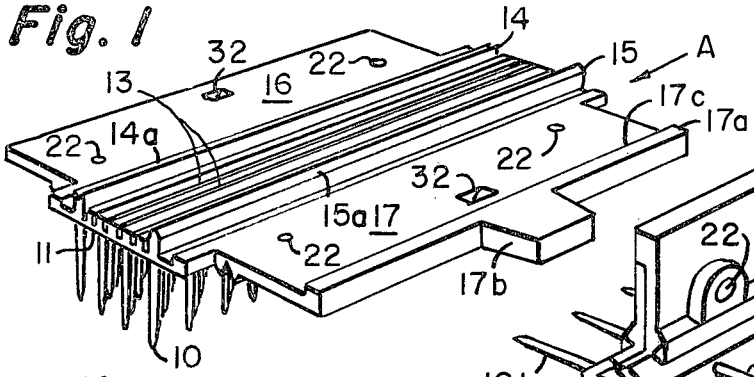
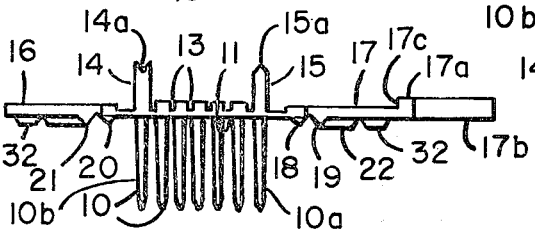
Fig. 2
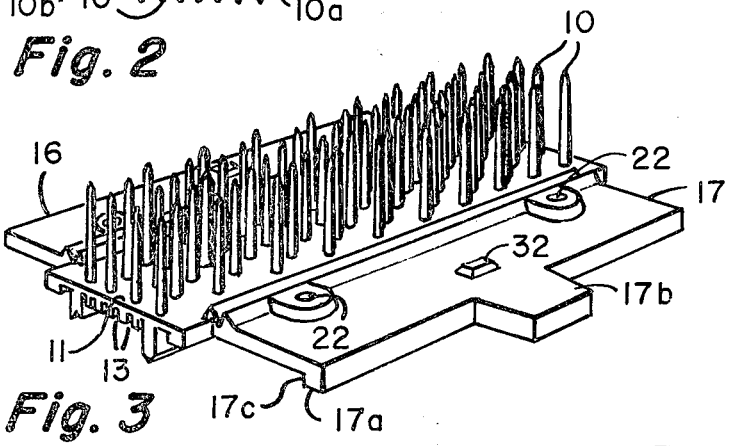
Fig. 3
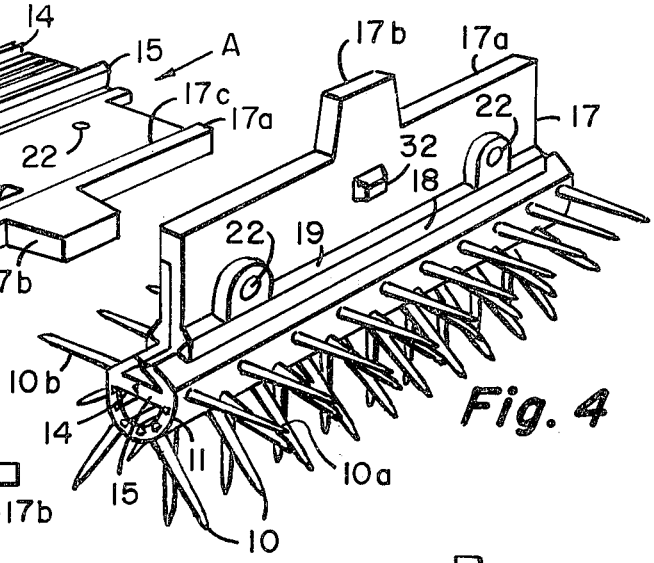
Fig. 4
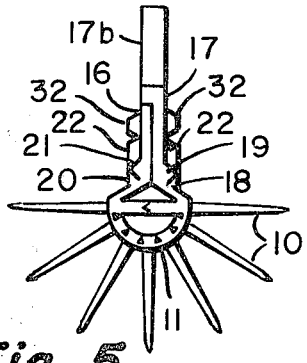
Fig. 5
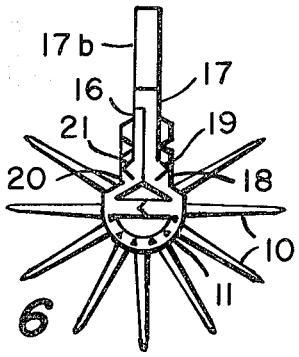
Fig. 6
Fig. 7
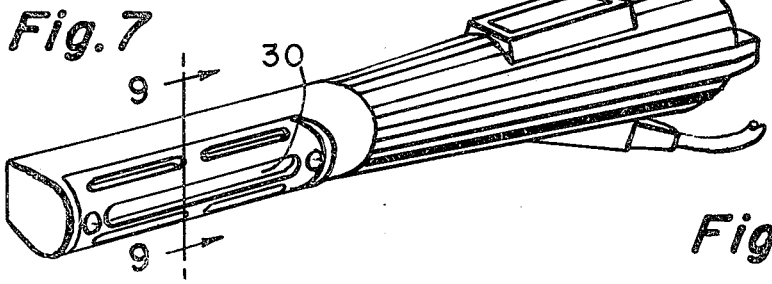
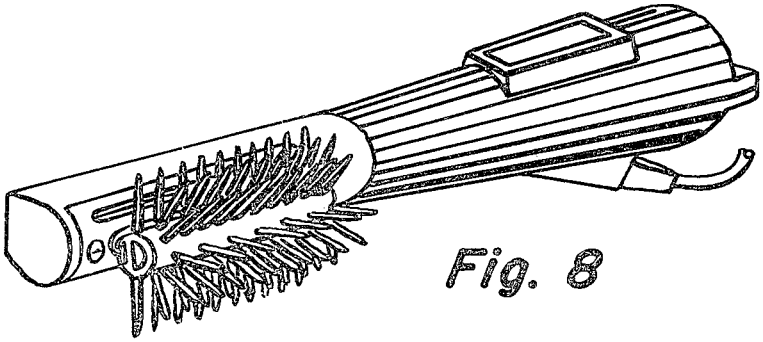
Fig. 8
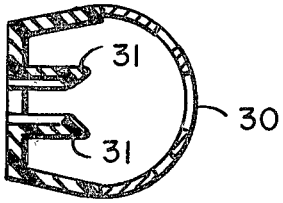
Fig. 9

BRUSH AND METHODS FOR MANUFACTURING SAME

This invention relates to a brush and to methods of forming the same. More particularly the invention pertains to a brush which can be molded in one piece and then bent into a desired shape.

BACKGROUND

During the past several years many manufacturers have made and sold devices for grooming the hair. Some of these devices are designed to supply heated air to dry the hair after it is washed and many of the devices have combs or brushes used to manipulate the hair so as to produce a desired grooming effect. Such combs or brushes have outwardly extending bristles or teeth which are pulled or in some way moved through the hair to untangle it or to put it into a desired orientation. The bristles may be natural fibers, but more recently have been made principally of synthetic or plastic materials. A common method of manufacture is to prepare a plastic piece, drill holes into the side of the piece at various angles and insert the teeth or bristles into the holes.

For convenience I use the term "teeth" to designate the bristles or toothlike projections however fine or coarse they may be.

It would be very desirable if methods were available to manufacture the brushes in a way which would be more effective and less costly than methods heretofore available, particularly methods for making brushes which have teeth extending at divergent angles from each other. It would be desirable to have a brush which has its teeth molded integrally with the base piece and would be especially desirable to have such a brush in which the teeth extend at desired divergent angles.

Accordingly, I have set myself to the provision of such brushes and have sought effective ways for their manufacture.

SUMMARY

I have discovered that a substantially flat piece may be molded having teeth extending from its outside and which may be bent to form a roll structure having a hollow arcuate cross section with the teeth extending at divergent angles, and further that the side portions of such a piece may be turned inwardly and fastened to hold the piece in its bent form. Further these side portions when so brought together may also serve as a handle for the brush or to engage a separate handle or styler device.

DETAILED DESCRIPTION

One embodiment of my improved device is illustrated in the accompanying drawings in which:

FIG. 1 is a perspective view of a molded piece having teeth extending downwardly from its outside;

FIG. 2 is an end elevational view of the structure shown in FIG. 1;

FIG. 3 is a perspective view like FIG. 1, but with the teeth inverted;

FIG. 4 is a perspective view of the piece as shown in FIGS. 1 to 3, but bent into its new shape;

FIG. 5 is an end view of the structure like that of FIG. 4, but showing seven rows of teeth;

FIG. 6 is a view like FIG. 5, but showing a modification in which the rows of teeth diverge by an angle of over 180°;

FIG. 7 is a perspective view of a hair dryer/styler;

FIG. 8 is a perspective view like FIG. 7, but showing the improved brush in place; and FIG. 9 is a sectional view taken along 9—9 of FIG. 7 and showing the resilient latch for fastening the brush element.

The improved brush element A may be prepared preferably by molding and may have the appearance illustrated in FIGS. 1 to 3 of the drawing.

As shown, this brush element A is substantially flat and has the teeth 10 extending from the outside (the bottom side is shown in FIG. 1) of the central section 11. As shown, there are seven longitudinal rows of teeth with ten teeth in a row. The brush will have a plurality of teeth, but may have any number of rows and any number of teeth in a row, or the teeth may not even be in rows at all. In the piece as it is molded, the teeth may preferably extend straight out from the section 11 in parallel fashion substantially normal to the plane of section 11.

The inside of section 11 (the top side as seen in FIG. 1) preferably has two or more spaced grooves 13 extending longitudinally of the section. As will later be understood more clearly these grooves aid in the bending of this section into a desired form. As shown more clearly in FIG. 2 the grooves 13 are each disposed opposite the space between the rows of teeth so that the grooves aid in the bending of the material between the rows.

On the inside of section 11 near the left side edge thereof is a longitudinal ridge 14 (FIGS. 1 and 2) having a groove 14*a* in its top, and near the right-hand side edge is a second longitudinal ridge 15 having a tongue 15*a* in its top. As will later be explained more fully the tops of these ridges come into engagement when the element is bent into its new form.

At the left-hand side of section 11 (as seen in FIG. 1) is a flap 16 and at the right-hand side is a flap 17. The flap 17 is longer than flap 16 and has a thickened portion 17*a* at its outer edge, and this is extended at the center to form the tongue 17*b*. The portion 17*a* has an inward edge 17*c* which is adapted to abut the outer edge of the flap 16 when the section is bent to its new form.

Referring now to the outside of the element (the top side as shown in FIG. 3), a pair of ridges 18, 19 is provided, ridge 18 being at the side edge of section 11 and ridge 19 being on the flap 17. These ridges provide between them a weakened line of material which serves as a hinge for flap 17. Further, these ridges come into side abutment with each other when the element is bent to its new form, thus to support the flap portion of the structure against turning to one side. A similar pair of ridges 20, 21 is provided at the other side edge of section 11 and these provide between them a hinge for flap 16 and also support for the flap.

In the illustrated embodiment flap 16 and 17 are provided with registering holes 22 for receiving rivets therethrough to fasten the flaps together.

A first step in the manufacture of my improved brush is the molding of the brush element A. It may be noted that especially with teeth 10 extending substantially normal to section 11 and without expansions or protrusions on any upwardly or downwardly extending parts, this element may be easily molded without difficulty in a simple straight opening mold without side pulls. The element may be made of any suitable moldable material which will take some degree of deformation. I prefer to use a polymeric amide such as nylon.

We may note also that when larger coarser teeth are desired, or when finer teeth are desired, this may be accomplished simply by changing the teeth portion of the mold rather than the whole mold.

Preparatory to bending the element into its new form I prefer to heat it by placing it in warm water to assist in the bending action. To bend the element the side edges of section 11 are pressed upwardly and inwardly (FIGS. 1 and 2) finally bringing flap 16 and 17 flatly together with the outer edge of flap 16 abutting the edge 17*c* of the thickened portion 17*a*. During this movement the ridges 14 and 15 will come into abutment with groove 14*a* serving to guide the ridges into abutting relation. Also during this movement the ridge 14 will come into side abutting relation with ridge 15 and the ridge 20 will come into side abutting relation with ridge 21 to hold the flaps against side movement. Note also that the inside of thickened portion 17*a* is flush with the outside of the flap 16 to provide a smooth surface for the handle portion provided by flaps 16 and 17.

To secure the flap 16 and 17 together I prefer to use rivets extending through the holes 22 in the flaps, but these flaps may be attached together by adhesive or other suitable means.

As the bending of section 17 takes place the grooves 13 on the inside surface of the section will close and the section will come to have an arcuate cross section, and the teeth 10 will extend outwardly at angles from each other. As shown in FIGS. 4 and 5, the arc of section 11 extends for about 180° and the tooth 10*a* extends outwardly in a direction 180° from tooth 10*b*. The arc over which the teeth are spread may extend, for example, about 90° or 270° or more, as may be desired.

The brush element in its new form may be used by grasping the handle portion provided by the attachments of the flaps, or this portion of the brush element may be inserted through the opening 30 in a styler/dryer. The tongue 17*b* may be inserted between the spring-pressed prongs 31 until there is contact between the knob 32 on flap 17 and the prongs 31. When the operator wishes to use a brush with a different size or tooth configuration, he may simply remove the one brush element and replace it with another one having the desired form.

While I have shown in the drawings and described in detail only one embodiment of the invention with some few variations, it should be understood that wide variation is possible and many changes may be made all within the spirit of the invention and within the scope of the appended claims.

I claim:

1. A brush element comprising a center section having an arcuate cross section, a plurality of spaced teeth extending from the outside of said section, and means for holding the side edges of said section together to maintain said section in arcuate form.

2. A brush element as set forth in claim 1 wherein said section has a plurality of spaced straight parallel grooves on its inside to facilitate the bending of said section into arcuate form.

3. A brush element as set forth in claim 1 wherein said means includes a flap connected to one side edge of said section and a flap connected to the other side edge of said section, and means for attaching said flaps together.

4. A brush element as set forth in claim 1 including a pair of spaced parallel ribs extending inwardly from the inside of section, the tops of said ribs being in abutting relation so as to support said section in its arcuate form.

5. A brush element as set forth in claim 3 wherein said means includes a rivet extendable through each of said flaps.

6. A brush element as set forth in claim 3 wherein one of said flaps has an abutment against which an edge of the other of said flaps may be received to position one flap with respect to the other.

7. A brush element as set forth in claim 3 including parallel ribs, one of which extends along one of said side edges of said outside of said section, said ridges providing between them a hinge for one of said flaps and a pair of parallel ribs, one of which extends along the other side edge of the outside of said section, said last mentioned ridges providing between them a hinge for the other of said flaps.

8. A brush element as set forth in claim 7 in which each of said ridges is in side abutting relationship with the other ridge of the pair when said flaps are in position with one flap flat against the other.

9. A brush element as set forth in claim 3 wherein said section has on its outside at one side edge a ridge and the flap which is connected to said side edge has a ridge, said ridges providing between them a hinge for the flap, said ridges being in side abutting relationship when said flaps are attached by said last mentioned means to thereby anchor said flap against movement to one side about said hinge.

10. In combination, a brush element as set forth in claim 3 wherein one of said flaps has a tongue extending outwardly of said flap, and a handle member, said handle member having means for engaging said tongue for holding said brush element to said handle, said means being releasable to permit separating of said element from said handle member.

11. A brush element as set forth in claim 3 wherein one of said flaps is longer than the other and wherein said one flap has a thickened portion at its outer end, said thickened portion having its inside flush with the outside of the other of said flaps to provide a smooth surface.

12. A brush element as set forth in claim 3 in which said flap when fastened by said means forms a handle adapted for insertion into a dryer device.

13. A brush element as set forth in claim 12 which includes a projection on said handle and a dryer device having a casing containing an opening therein, and a latching device within said casing, said latching device being arranged to engage said projection when said projection is inserted through said opening, to hold said brush and said dryer device together.

14. In a method for forming a brush element the steps of molding a plastic piece having a plurality of teeth extending from its outside, bending said piece into a form in which it has an arcuate cross section, and securing the side edges of said piece in engaging contact with each other to maintain said piece in said form.

15. A method of forming a brush element as set forth in claim 14 wherein grooves are molded into the inside of said piece and wherein said grooves are closed as said piece is bent into said form.

16. A method as set forth in claim 14 wherein a pair of ridges is molded on the outside of said piece inward of one side edge thereof to provide a side flap hinged along a line between said ridges and wherein a second pair of ridges is molded on the outside of said piece inward of the other side of said piece to provide a second side flap hinged along a line between said last mentioned pair of ridges, and bringing said flaps together to bring one ridge of each pair into abutting relationship with the other ridge of its pair to thereby anchor said flaps against side movement.

17. A method as set forth in claim 15 wherein a ridge is molded on each side of said groove, and wherein the tops of said ridges are moved into abutting relationship as said piece is bent into arcuate form.

18. In a brush element, a substantially flat section having an outside and an inside, a plurality of teeth extending from said outside in a direction substantially normal to the plane of said section, said section being bendable to bring its side edges inward toward each other and to bring said section into hollow arcuate form in which said teeth extend from said section in divergent angular directions, said section having a pair of ridges on said inside which are spaced so that their tops abut each other when said section is bent into arcuate form.

19. A brush element as set forth in claim 18 in which one of said ridges has a tongue and the other has a groove, said tongue and groove being in engagement when said ridges are in abutting relationship.

* * * * *